United States Patent [19]

McGregor et al.

[11] Patent Number: 4,649,386

[45] Date of Patent: Mar. 10, 1987

[54] DATA ACQUISITION

[75] Inventors: Robert E. McGregor; Thomas J. Hubbard, both of Bartlesville, Okla.

[73] Assignee: Phillips Petroleum Company, Bartlesville, Okla.

[21] Appl. No.: 518,589

[22] Filed: Jul. 29, 1983

[51] Int. Cl.[4] ..... G08C 19/00

[52] U.S. Cl. ..... 340/870.24; 340/825.63; 340/825.66

[58] Field of Search ..... 375/22; 340/825.63, 340/825.65, 825.66, 825.67, 870.13, 870.24; 370/91

[56] References Cited

U.S. PATENT DOCUMENTS 3,246,131 4/1966 Webb et al. .
3,500,024 3/1970 Stacy et al. ..... 340/870.13
3,508,003 4/1970 Moyers .
3,616,692 11/1971 Keller .
3,686,634 8/1972 Malchman et al. .
3,747,083 7/1973 Cola ..... 340/870.24
3,831,170 8/1974 Christenson .
4,348,670 9/1982 DeShon .

*Primary Examiner*—Ulysses Weldon
*Attorney, Agent, or Firm*—French and Doescher

[57] ABSTRACT

In a system in which a continuous, periodically repeated, pulse duration type signal is utilized to transmit information to a computer, the pulse duration type signal is converted into a series of clock pulses. The clock pulses are then counted for a period of time equal to the repetition period of the pulse duration type signal. This count is then latched and transferred to the computer to thereby accomplish the transfer of information to a computer by means of a continuous, periodically repeated, pulse duration type signal.

14 Claims, 2 Drawing Figures

DATA ACQUISITION

This invention relates to data acquisition. In one aspect, this invention relates to method and apparatus for the computer acquisition of data transmitted by means of continuous, periodically repeated, pulse duration type signals.

As used herein, the term "pulse duration type signals" refers to signals in which the width of a pulse is representative of some variable such as a pressure or temperature. The pulse is generally a change in state of the signals such as a change from a logic low to a logic high level or a change from 0 volts to +5 volts or some other similar change.

The pulse will remain in one state for a length of time (pulse duration) which is representative of the information to be transferred. As an example, if pressure is being measured, a pulse width or duration of 3 seconds could be representative of 0 psi, 7½ seconds could be representative of 50 psi and 12 seconds could be representative of 100 psi.

In many measurement systems, pulse duration type signals are utilized to transfer information from a remote location to a central location. Typically, the information is periodically repeated such that a change in some process variable being monitored is recognized. As an example, a pulse duration type signal representative of a pressure may be transmitted every 15 seconds. The pulse duration during the 15 seconds would be indicative of the pressure. Thus, the pulse duration type signal, which is representative of a pressure, will be periodically repeated (every 15 seconds in the above example). The pulse duration type signals which are periodically repeated will also be continous. By the term "continuous" it is meant that the period of repetition are not separated. Thus, whatever information is available is transmitted every 15 seconds (using the above example). There is no delay between the 15 second periods.

Figure 1:
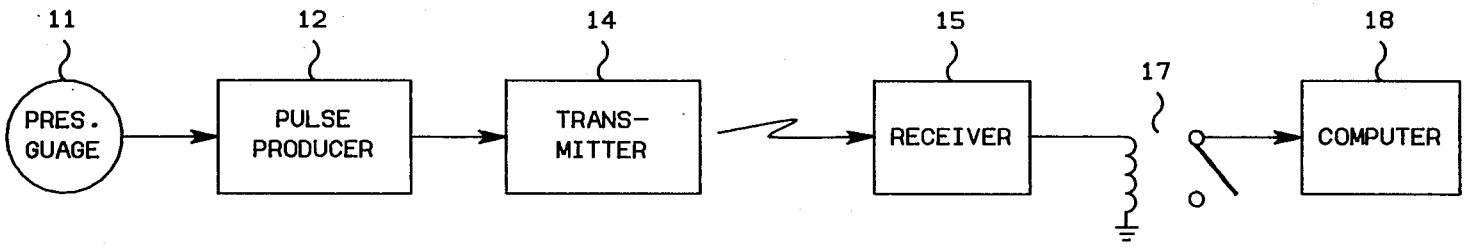
PRIOR ART FIG. 1
Figure 2:
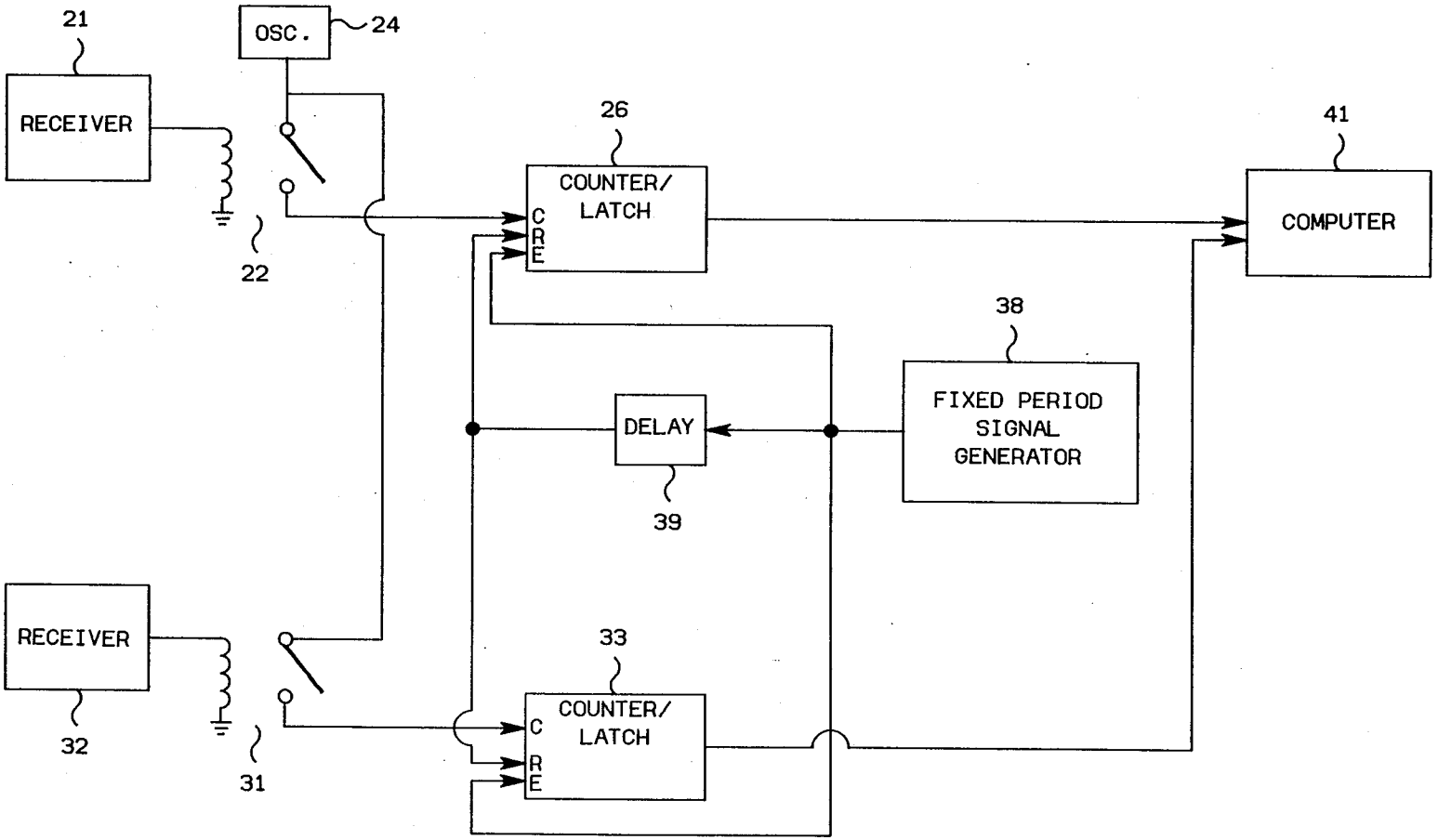

The drawings, which are briefly described as follows, will be utilized to provide both background information concerning the present invention and also to provide a detailed description of the present invention:

FIG. 1 is an illustration of a prior art system for the computer acquisition of data transmitted by means of a continuous, periodically repeated, pulse duration type signal; and FIG. 2 is a block diagram of the circuitry employed in the present invention to provide a system for the computer acquisition of data transmitted by means of a continuous, periodically repeated, pulse duration type signal.

Referring now to FIG. 1, there is illustrated a system which is typical of instrumentation used to acquire and transmit data in the form of continuous, periodically repeated, pulse duration type signals. An instrument such as that illustrated in FIG. 1, except for the computer, is referred to as a metameter supplied by Bristol Instrument, Inc.

For this particular instrument, a pressure gauge 11 is utilized to measure the desired pressure such as the pressure in a gas pipeline. This pressure is transmitted to the pulse producer 12 which provides an output pulse to the transmitter 14. The signal supplied from the pulse producer 12 is continuous and the period of repetition is 15 seconds. The pulse will always go from a low state to a high state at the beginning of the 15 seconds and will remain in the high state for at least 3 seconds which is representative of 0 psi. Other pulse widths can be scaled to be representative of other pressures.

The pulse duration type signal is transmitted from the transmitter 14 by means of a transmission medium, such as a transmission line, to the receiver 15. When the pulse signal is in a high state the switch 17 will be closed and when the pulse signal is in a low state the switch 17 will be open. The switch may be connected to a power supply or contact sensing may be utilized. In either case, a computer reads the state of the switch directly. In a typical system, the read operation may be executed every 12 milliseconds to insure that a change in the state of the switch 17 is promptly detected.

In many operations, hundreds of pressure measurements may be transmitted to the central computer 18. As an example, natural gas companies may desire to remotely monitor the pressure for hundreds of pipelines and pumping stations. A separate instrument, such as the metameter described in FIG. 1, will be associated with each pipeline or pumping station measurement. The transmission from each of the remote instruments will generally be asynchronous with respect to the other remote instruments.

When the computer 18 is reading the state of the switch 17 directly, it becomes difficult to read the switch 17 directly without overloading the computer. However, it is desirable to be able to use only one computer to avoid the expense of additional computer installations. It is thus an object of this invention to provide a system for the computer acquisition of data transmitted by means of a continuous, periodically repeated, pulse duration type signal which avoids the problem caused by reading the switch directly as illustrated in FIG. 1.

In accordance with the present invention, method and apparatus is provided for converting the pulse duration type signal into a series of clock pulses. The clock pulses are then counted for a period of time equal to the repetition period of the pulse duration type signal. This count is then latched and transferred to a computer during the next period of repetition.

Essentially, for a pulse duration type signal in which the length of the pulse, when the pulse is in a first state, is representative of a variable, the clock pulses will be generated only when the pulse is in the first state. Counting the pulses thus provides an indication of the pulse width. However, since the signals are periodically repeated, it is not necessary to trigger off the leading edge of the pulse since any 15 second period will provide the desired information. Also, it is not necessary for the transmitters of the pulse duration type signals to be synchronized. It is only necessary that the counters be synchronized so that all data will be available to the computer at the same time.

Other objects and advantages of the invention will be apparent from the foregoing brief description of the invention and the claims as well as the detailed description of the invention which follows.

The invention is illustrated in terms of specific circuitry which may be utilized. However, the invention is not limited to any specific circuit configuration but is rather applicable to any circuit configuration which achieves the purpose of converting the pulse duration type signal into a clock signal, storing a count representative of the width of the pulse duration signal and transferring the thus stored count to a computer.

The invention is also illustrated in terms of a specific pulse duration type signal and specific oscillator frequencies. Other frequencies and periods of repetition can be utilized if desired.

Referring now to FIG. 2, there is illustrated a receiver 21 and switch 22 which correspond to the receiver 15 and switch 17 illustrated in FIG. 1. The output of a one kilohertz oscillator 24 is tied to one pole of the switch 22. The second pole of the switch 22 is tied to the count input of a counter/latch 26 which may be implemented using 85L54 binary counter/latches. In the present case, where the oscillator 24 is a one kilohertz oscillator, four 85L54's connected in cascade are utilized to implement the counter/latch 2.

The output of the oscillator 24 is also tied to one pole of the switch 31 associated with the receiver 32. The second pole of switch 31 is tied to the count input of the counter/latch 33 which is identical to the counter/latch 26.

The fixed period signal generator 38 is utilized to generate a signal having a period equal to the period of repetition of the pulse duration type signal being received by the receiver 21 and 32. For the sake of illustration, this period repetition will again be assumed to be 15 seconds. Thus, the output from the fixed period signal generator 38 will be a periodic signal where the period is equal to 15 seconds. Preferably, a four megahertz crystal in conjunction with a MK5009 programmable divider is utilized as the fixed period signal generator 38. The output signal from the fixed period signal generator 38 is taken from the time out output of the MK5009 programmable divider. The output from the signal generator 38 is supplied to the delay circuit 39 and is also provided to the enable input of the counter/-latches 26 and 33.

The delay circuit 39 can be a simple flip-flop which is clocked by the 4 megahertz clock utilized for the fixed period signal generator 38. Essentially, the delay circuit 39 acts to delay the transition of the output pulse from the fixed period signal generator 38 by one clock period (4 megahertz clock). The output from the delay circuit, which would typically be the Q output from a flip-flop, is provided to the reset input of both the counter/latch 26 and the counter/latch 33. A flip-flop which may be used is a 74LS74.

The data received by the receiver 21 and receiver 32 will typically be asynchronous. Thus, the switch 22 and switch 31 will be closed at different times even if the variable being monitored in each case has the same value. However, even though the received data will be asynchronous, the period of repetition of the received data will be the same as the period of the output signal from the fixed period signal generator 38.

As an example of the operation of the circuit illustrated in FIG. 2, assume that the pulse received by the receiver 21 is high for 7½ seconds and is representative of a pressure of 50 psi. Also assume that a high signal received by receiver 21 will close the switch 22. Thus, the switch 22 will be closed for 7½ seconds. The counter/latch 26 will count to 7500 during the 15 second period after the counter/latch is reset by the output from the fixed period signal generator 38 since the switch will be closed only for 7½ seconds.

At the end of the 15 second period, the count will be transferred to the latch automatically by the transition of the output signal from the fixed period signal generator 38. One clock period later (4 megahertz clock) the counter/latch will be reset and can again begin counting when the switch 22 is closed.

The count is also stored in the latch section of the counter/latch 33 in the same manner as described for the counter/latch 26. The count will generally be different but, again, the count will be acquired in the 15 second period of the output signal from the fixed period signal generator 38. Thus, while the closing of the switches 22 and 31 as a result of the state of the pulse duration type signal are not synchronized, the counters are synchronized since both are reset by the same output signal from the fixed period signal generator 38.

During the next 15 second counting period, the latched data is transferred to the computer 41 by a conventional read operation. The read operation can be conducted at any desired time. The presently preferred time is 12 seconds into 15 second period. The output from several hundred counters can be transferred to the computer 41 during the read operation.

In summary, the present invention relies on the fact that the data is periodically repeated. Thus, it is not necessary to trigger each counter on the leading edge of a transition in the pulse duration type signal since the same data, in the form of a count, can be acquired in any 15 second period. All of the counters can be reset from the output from a single fixed period signal generator which synchronizes all of the counters and all data is available for the computer to acquire in any single read operation.

It is noted that the invention could be utilized where only a single receiver is involved. However, the invention is most applicable where multiple receivers are being utilized to transfer information from remote locations to a central computer facility.

The invention has been described in terms of a preferred embodiment as illustrated in FIG. 2. Again, the invention is not limited to the specific circuit configuration illustrated. It is well-known that there are many circuit configurations which can be utilized to perform specified functions. This is especially true with regard to elements in the circuits which are supplied by a plurality of manufacturers.

While the invention has been described in terms of the presently preferred embodiment, reasonable variations and modifications are possible by those skilled in the art and such variations and modifications are within the scope of the described invention and the appended claims.

That which is claimed is:

1. Apparatus comprising:

means for generating a first pulse duration type signal wherein said first pulse duration type signal is periodically repeated every time period p, wherein said first pulse duration type signal is in a first state for a portion of said time period p and is in a second state for a portion of said time period p, wherein the length of time said pulse duration type signal is in said first state is representative of the value of a first variable and wherein said first pulse duration type signal is continuous;

means for converting said first pulse duration type signal to a first clock signal when said first pulse duration type signal is in said first state;

a first counter having a count input and an enabling input;

means for supplying said first clock signal to the count input of said first counter;

means for supplying a fixed period signal having a period equal to said time period p to the enabling input of said first counter, wherein the count reached by said first counter in a time period equal to said time period p is representative of the time said first pulse duration type signal is in said first state;

a computer; and means for transferring the count reached by said first counter to said computer to thereby transfer to said computer the value of said first variable.

2. Apparatus in accordance with claim 1 additionally comprising;

means for generating a second pulse duration type signal, wherein said second pulse duration type signal is periodically repeated every said time period p, wherein said second pulse duration type signal is in said first state for a portion of said time period p and is in said second state for a portion of said time period p, wherein the length of time that said second pulse duration type signal is in said first state is representative of the value of a second variable, wherein said second pulse duration type signal is continuous and wherein said first pulse duration type signal and said second pulse duration type signal are asynchronous;

means for converting said second pulse duration type signal to a second clock signal when said second pulse duration signal is in said first state;

a second counter having a count input and an enabling input;

means for supplying said second clock signal to the count input of said second counter;

means for supplying said fixed period signal to the enable input of said second counter, wherein the count reached by said second counter in a time period equal to said time period p is representative of the time said second pulse duration type signal is in said first state; and means for transferring the count reached by said second counter to said computer to thereby transfer to said computer the value of said second variable.

3. Apparatus in accordance with claim 2 wherein a first switch having first and second poles is closed when said first pulse duration type signal is in said first state, wherein said first switch is open when said first pulse duration type signal is in said second state and wherein said means for converting said first pulse duration type signal to said first clock signal and said means for supplying said first clock signal to the count input of said first counter comprises:

a first oscillator having a first frequency;

means for supplying the output of said first oscillator to said first pole of said first switch; and means for connecting said second pole of said first switch to the count input of said first counter, wherein said first clock signal has said first frequency and wherein said first clock signal is supplied to the count input of said first counter only when said first switch is closed.

4. Apparatus in accordance with claim 3 wherein a second switch having first and second poles is closed when said second pulse duration type signal is in said first state, wherein said second switch is open when said second pulse duration type signal is in said second state and wherein said means for converting said second pulse duration type signal to said second clock signal and said means for supplying said second clock signal to the count input of said second counter comprises:

means for supplying the output of said first oscillator to said first pole of said second switch; and means for connecting said second pole of said second switch to the count input of said second counter, wherein said second clock signal has said first frequency and wherein said second clock signal is supplied to the count input of said second counter only when said second switch is closed.

5. Apparatus in accordance with claim 4 wherein said means for supplying said fixed period signal to the enabling input of said first counter and said means for supplying said fixed period signal to the enabling input of said second counter comprises:

a second oscillator having a second frequency;

a frequency divider;

means for providing the output of said second oscillator to said frequency divider to thereby establish an output signal having said time period p;

means for supplying the output from said frequency divider to the enabling input of said first counter as said fixed period signal; and means for supplying the output of said frequency divider to the enabling input of said second counter as said fixed period signal.

6. Apparatus in accordance with claim 5 additionally comprising:

a delay circuit;

means for providing the output from said second oscillator to said delay circuit as a clock signal;

means for providing said fixed period signal to said delay circuit, wherein said delay circuit operates to delay the transition of said fixed period signal by a time determined by said second frequency;

means for providing the fixed period signal, which has been delayed, from said delay circuit to the reset input of said first counter to thereby reset said first counter after said time period p; and means for providing the fixed period signal, which has been delayed, from said delay circuit to the reset input of said second counter to thereby reset said second counter after said time period p.

7. Apparatus in accordance with claim 6 wherein the count reached by said first counter is latched in said first counter at the end of said time period p by a transition of said fixed period signal, wherein said means for transferring the count reached by said first counter to said computer comprises means for reading the count latched in said first counter into said computer, wherein the count reached by said second counter is latched in said second counter at the end of said time period p by a transition of said fixed period signal and wherein said means for transferring the count reached by said second counter to said computer comprises means for reading the count latched in said second counter into said computer.

8. A method for transferring data to a computer comprising the steps of:

generating a first pulse duration type signal, wherein said first pulse duration type signal is periodically repeated every time period p, wherein said first pulse duration type signal is in a first state for a portion of said time period p and is in a second state for a portion of said time period p, wherein the length of time said pulse duration type signal is in said first state is representative of the value of a first variable and wherein said first pulse duration type signal is continuous;

converting said first pulse duration type signal to a first clock signal when said first pulse duration type signal is in said first state;

supplying said first clock signal to a count input of a first counter;

supplying a fixed period signal having a period equal to said time period p to an enabling input of said first counter, wherein the count reached by said first counter in a time period equal to said time period p is representative of the time said first pulse duration type signal is in said first state; and transferring the count reached by said first counter to said computer to thereby transfer to said computer the value of said first variable.

9. A method in accordance with claim 8 additionally comprising the steps of:

generating a second pulse duration type signal, wherein said second pulse duration type signal is periodically repeated every said time period p, wherein said second pulse duration type signal is in said first state for a portion of said time period p and is in said second state for a portion of said time period p, wherein the length of time that said second pulse duration type signal is in said first state is representative of the value of a second variable, wherein said second pulse duration type signal is continuous and wherein said first pulse duration type signal and second pulse duration type signal are asynchronous;

converting said second pulse duration type signal to a second clock signal when said second pulse duration signal is in said first state;

supplying said second clock signal to a count input of a second counter;

supplying said fixed period signal to an enable input of said second counter, wherein the count reached by said second counter during said time period p is representative of the time said second pulse duration type signal is in said first state; and transferring the count reached by said second counter to a computer to thereby transfer to said computer the value of said second variable.

10. A method in accordance with claim 9 wherein a first switch having first and second poles is closed when said first pulse duration type signal is in said first state, wherein said first switch is open when said first pulse duration type signal is in said second state and wherein said step of converting said first pulse duration type signal to said first clock signal and said step of supplying said first clock signal to the count input of said first counter comprises:

supplying the output of a first oscillator having a first frequency to said first pole of said first switch; and connecting said second pole of said first switch to the count input of said first counter, wherein said first clock signal has said first frequency and wherein said first clock signal is supplied to the count input of said first counter only when said first switch is closed.

11. A method in accordance with claim 10 wherein a second switch having first and second poles is closed when said second pulse duration type signal is in said first state, wherein said second switch is open when said second pulse duration type signal is in said second state and wherein said step of converting said second pulse duration type signal to said second clock signal and said means for supplying said second clock signal to the count input of said second counter comprises:

supplying the output of said first oscillator to said first pole of said second switch; and connecting said second pole of said second switch to the count input of said second counter, wherein said second clock signal has said first frequency and wherein said second clock signal is supplied to the count input of said second counter only when said second switch is closed.

12. A method in accordance with claim 11 wherein said step of supplying said fixed period signal to the enabling input of said first counter and said step of supplying said fixed period signal to the enabling input of said second counter comprises:

providing the output of a second oscillator having a second frequency to a frequency divider to thereby establish an output signal having said time period p;

supplying the output from said frequency divider to the enabling input of said first counter as said fixed period signal; and supplying the output of said frequency divider to the enabling input of said second counter as said fixed period signal.

13. A method in accordance with claim 12 additionally comprising the steps of:

providing the output from said second oscillator to a delay circuit as a clock signal;

providing said fixed period signal to said delay circuit, wherein said delay circuit operates to delay the transition of said fixed period signal by a time determined by said second frequency;

providing the fixed period signal, which has been delayed, from said delay circuit to the reset input of said first counter to thereby reset said first counter after said time period p; and providing the fixed period signal, which has been delayed, from said delay circuit to the reset input of said second counter to thereby reset said second counter after said time period p.

14. A method in accordance with claim 13 wherein the count reached by said first counter is latched in said first counter at the end of said time period p by a transition of said fixed period signal, wherein said step of transferring the count reached by said first counter to said computer comprises reading the count latched in said first counter into said computer, wherein the count reached by said second counter is latched in said second counter at the end of said time period p by a transition of said fixed period signal and wherein said step of transferring the count reached by said second counter to said computer comprises reading the count latched in said second counter into said computer.

* * * * *